US005220953A

United States Patent [19]

Jacobsen

[11] Patent Number: 5,220,953

[45] Date of Patent: Jun. 22, 1993

[54] NEAR PLATE WITH AIR-ESCAPE NOZZLES FOR USE IN PRESSES FOR MAKING FLASKLESS SAND MOLDS

[75] Inventor: Arne T. Jacobsen, Skovlunde, Denmark

[73] Assignee: Dansk Industri Syndikate A/S, Denmark

[21] Appl. No.: 849,500

[22] Filed: Mar. 11, 1992

[30] Foreign Application Priority Data

Mar. 14, 1991 [DK] Denmark ..... 0459

[51] Int. Cl.[5] ..... B22C 15/22; B22C 23/00

[52] U.S. Cl. ..... 164/200; 164/234; 164/410

[58] Field of Search ..... 164/200, 201, 202, 234, 164/410; 425/812

[56] References Cited

U.S. PATENT DOCUMENTS

| | | | |
|---|---|---|---|
| 3,188,701 | 6/1965 | McIntyre | 164/234 X |
| 3,529,656 | 9/1970 | Levy | 164/234 |
| 4,716,953 | 1/1988 | Prunty, II et al. | 164/200 |

FOREIGN PATENT DOCUMENTS

| | | | |
|---|---|---|---|
| 3026146 | 2/1982 | Fed. Rep. of Germany | 164/410 |
| 3319463 | 9/1985 | Fed. Rep. of Germany . | |
| 3613351 | 10/1987 | Fed. Rep. of Germany . | |
| 47-33411 | 8/1972 | Japan | 164/410 |

*Primary Examiner*—J. Reed Batten, Jr.
*Attorney, Agent, or Firm*—Larson & Taylor

[57] ABSTRACT

In a wear plate (16) with a number of air-escape nozzles, in the example shown consisting of annular gaps (27) formed between bores (17) in the wear plate (16) and nozzle members (21) screwed into the bores (17) to make the mold-chamber faces (26) on the nozzle members (21) align with the mold-chamber surface (20) on the wear plate (16) in order to avoid problems when a finished mold or mold part is moved slidingly along the mold-chamber surface (20), the novel feature consists in that the nozzle members (21) have been screwed tight against an abutment tool (23) held temporarily in close abutment (not with a small gap as shown) against the mold-chamber surface on the wear plate (16), after which the nozzle members (21) have been secured in the position of alignment achieved in a suitable manner, such as by using a settable cement (30) filling the spaces between the thread (18) in the bores (17) and the thread (22) on the nozzle members (21) and keeping flanks (31) on the nozzle-member thread (22) in engagement with flanks (32) on the bore thread (18). With this arrangement, there is no risk of the nozzle members coming out of alignment with the wear plate, even when subjected to the high sand pressures encountered in mold-making presses of the kind in question.

11 Claims, 4 Drawing Sheets

NEAR PLATE WITH AIR-ESCAPE NOZZLES FOR USE IN PRESSES FOR MAKING FLASKLESS SAND MOLDS

TECHNICAL FIELD

The present invention relates to wear plates of the kind including a plurality of air-escape nozzles and, in particular, to an improvement in the construction of such wear plates.

BACKGROUND ART

When using wear plates of the kind referred to as walls or linings for such walls in a mold-making press in positions, in which the finished mold or mold part is removed from the press by being moved along the mold chamber in sliding engagement with the wear plate, it is imperative that the nozzle members are perfectly flush with the surface of the wear plate facing the mold chamber. Otherwise, if the nozzle members protrude from said surface, they will score the mold part and be subjected to uncontrollable excessive wear on their edges, or if the nozzle members recede relative to said mold-chamber surface, then the "plug" formed on the mold or mold part will be sheared off during such movement, such action also causing uncontrollable excessive wear, in this case on the edges of the bores in the wear plate, in both cases producing loose sand highly likely to disturb the various mold-making and/or subsequent casting operations, as well as causing a considerable reduction of the useful life of the wear plate.

Some prior-art nozzle members are adapted to be screwed into the wear plate from the latter's mold-chamber surface. These nozzle members are, however, difficult to align properly with the mold-chamber surface, as the tool used for screwing them in in many cases obscures the view. It is a further disadvantage with these nozzle members that, due to tolerance variations between the interengaging members, the engagement between the external screw-thread on each nozzle member and the internal screw-thread in the corresponding bore in the wear plate is not sufficiently stable to prevent the nozzle members from coming out of alignment.

Other prior-art nozzle members have been fitted into the respective bores by using a tight press fit, but experience has shown this arrangement to cause warping of the wear plate with the consequent need of re-grinding after the nozzle members have been fitted. Apart from being comparatively costly, such re-grinding will also remove at least a part of the specially treated or hardened surface layer on the wear plate thus also causing the useful life of the wear plate to be reduced.

DISCLOSURE OF THE INVENTION

It is the object of the present invention to provide a wear plate of the kind referred to initially, in which proper alignment of the nozzle members with the wear plate is achieved and maintained, even against strong external forces, without any need for re-grinding the wear plate after the fitting of the nozzle members, and this object is achieved with a wear plate of the kind referred to above, which according to the present invention also exhibits the features set forth in the claims.

With this arrangement, the desired proper alignment of the mold-chamber surfaces on the nozzle members and on the wear plate is achieved in a simple operation demanding no particular care, after which the alignment is maintained indefinitely, because the initial engagement between the screw-thread on the nozzle members and the wear plate has been made permanent.

Advantageous embodiments of the wear plate according to the present invention, the effects of which are explained in more detail in the following detailed portion of the present specification, are set forth in claims 2–9.

BRIEF DESCRIPTION OF THE DRAWINGS

In the following detailed specification, the present invention will be explained in more detail with reference to the drawings, in which.

DESCRIPTION OF THE PREFERRED EMBODIMENT

Figure 1:
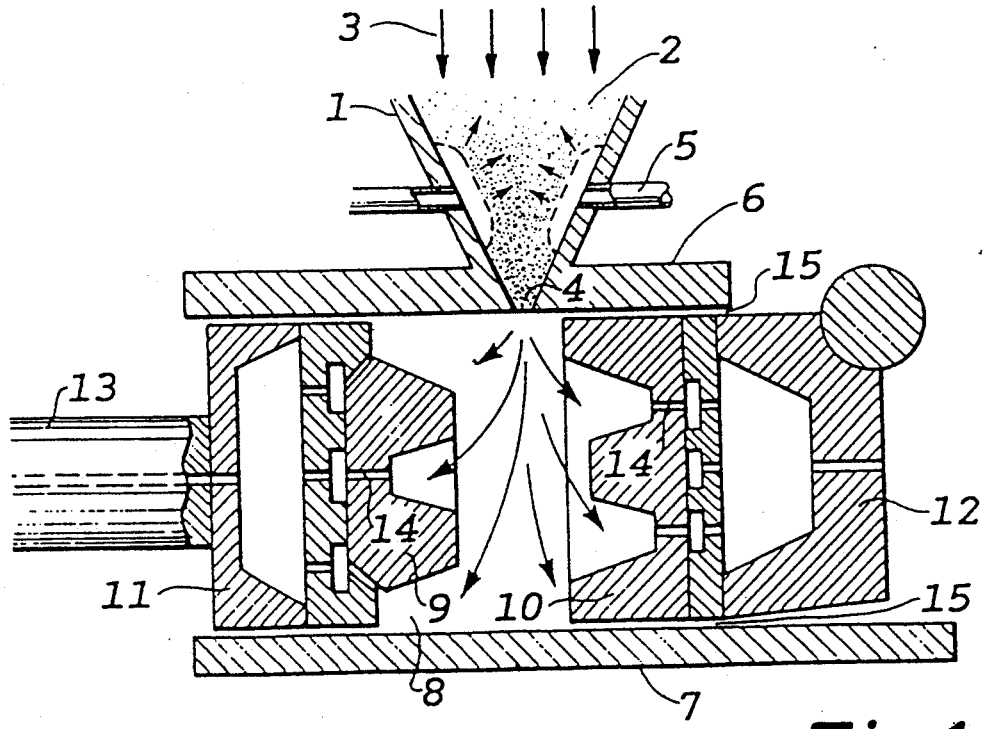
PRIOR ART Fig.1
FIGS. 1 and 2 are sectional views through a prior-art mold-making press, these Figures serving to illustrate the general principles involved, when a wear plate according to the present invention may be useful.

In the apparatus shown in FIG. 1, a sand supply chamber 1, of which only the lower part is shown, is adapted to receive sand from a sand supply container (not shown), and to store this mold sand 2 temporarily. During the actual molding operation, air under pressure is supplied to the closed space above the sand 2 as indicated by arrows 3, so that the mold sand 2, which is being kept in a fluidized state by air introduced through fluidization ducts 5, may be forced through an outlet 4 downwardly into a mold chamber 8.

The mold chamber 8, situated as shown below the sand supply chamber 1, is limited above and below by a top plate 6 and a bottom plate 7 respectively, and in the lateral directions by two pattern plates 9 and 10, as well as two side plates covering the sides of the mold chamber 8 facing toward and away from the observer, and hence not visible in FIG. 1. The pattern plates 9 and 10 are supported by squeeze plates 11 and 12 respectively. A piston arrangement, of which only a ram 11 is shown, is adapted to move the two squeeze plates 11 and 12 and hence the two pattern plates 9 and 10 towards each other with great force.

When the pattern plates 9 and 10 are moved towards each other, the sand having been introduced into the space between them is compacted so as to form a mold 19, in the present example adapted to be one of a number of individual mold parts to be arranged closely together to form a so-called mold string (not shown) such as described e.g. in the international application No. PCT/DK90/00079 from the present applicant.

During the compacting operation, the air contained in the sand must necessarily escape from the mold chamber 8, and means for this purpose, that are visible in FIG. 1, comprise a number of air passages 14 formed in the pattern plates 9 and 10, gaps 15 between the top and bottom plates 6 and 7 on the one hand and the pattern plates and squeeze plates 9, 10, 11 and 12 respectively on the other hand, as well as gaps (not shown) between the latter and the side plates (not shown) referred to above.

The air-escape facility provided by the passages and gaps referred to above is, however, not always sufficient to ensure an adequate removal of air from the mold or mold part being formed. This problem has been solved in previously known apparatus of this kind by means of a number of air-escape nozzles being distributed over those areas of the plates bounding the mold chamber, where a reduced flow resistance for the escaping air is desired. These nozzles are usually distributed over a number of so-called wear plates, used to line the walls bounding the mold chamber.

Figure 2:
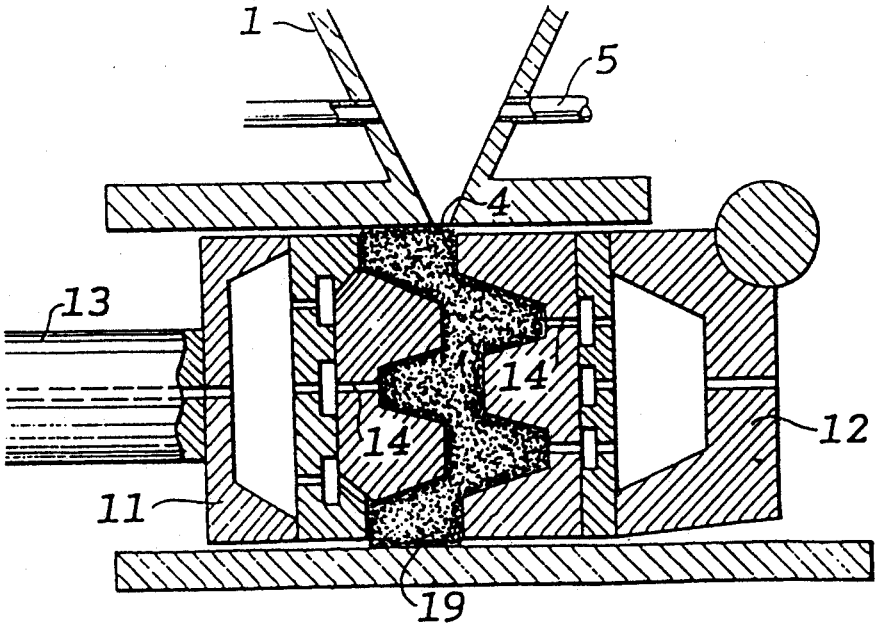
PRIOR ART Fig.2
Figure 3:
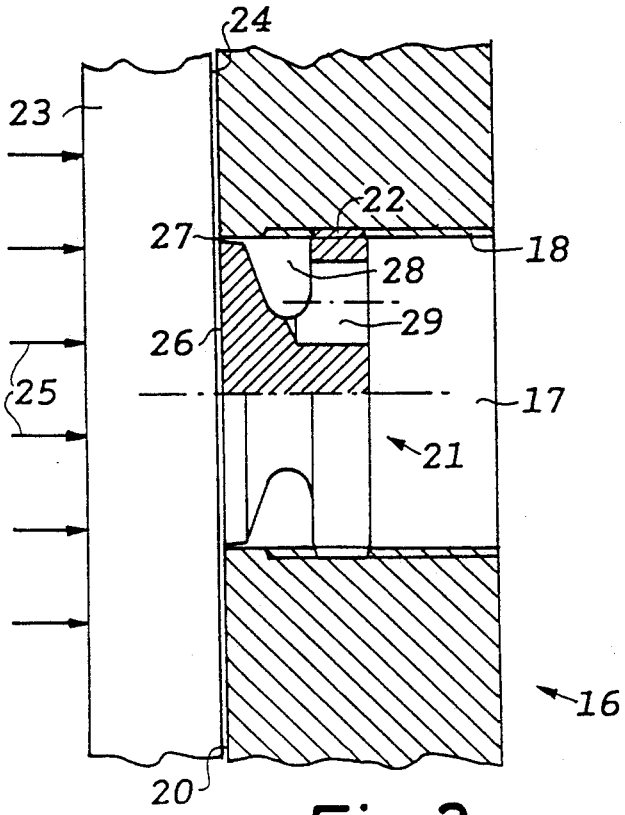
FIG. 3 is a sectional view of a part of a wear plate immediately surrounding a nozzle member according to an exemplary embodiment.
Figure 4:
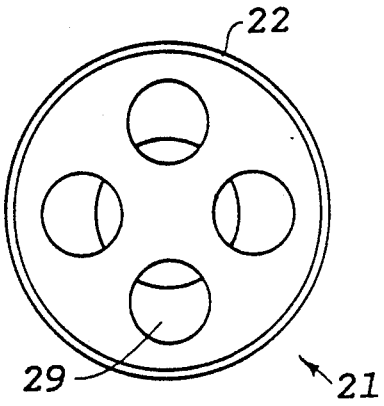
FIG. 4 shows the nozzle member of FIG. 3, seen from the side facing away from the mold chamber.

In the first exemplary embodiment of a wear plate according to the present invention shown in FIGS. 3 and 4, the wear plate 16, of which only a small part is shown, has a number of through bores 17 with an internal screw-thread 18 extending to within a short distance of the mold-chamber surface 20 facing a mold chamber, e.g. the mold chamber 8 shown in FIGS. 1 and 2.

A nozzle member 21 having an external screw-thread 22 is screwed into the bore 17 in engagement with the latter's internal thread 18. During the operation of fitting the nozzle member 21 to the wear plate 16, an abutment tool 23 with a plane surface 24 facing the mold-chamber surface 20 on the wear plate 16 is held with considerable force as indicated by arrows 25 in abutment with the mold-chamber surface 20, the small gap shown in FIG. 3 being reduced to zero. The nozzle member 21 is then screwed tightly up against the plane surface 24 on the abutment tool 23, after which the nozzle member 21 is secured in the position thus achieved in the bore 17 in a manner to be described below, before the abutment tool 23 is removed, leaving the plane mold-chamber face 26 in precise alignment with the mold-chamber surface 20 on the wear plate 16.

When the nozzle member 21 has been secured in this position in the bore 17, an annular gap 27, through which the air, but not the sand, may escape from the mold chamber, is formed between the mold-chamber face 26 and the annular edge between the bore 17 and the mold-chamber surface 20 on the wear plate 16. After having passed through the annular gap 27, the air will flow through a peripheral groove 28 and a number of holes 29, of which the latter advantageously may be used as engagement holes for a tool (not shown), with which the nozzle member 21 may be turned.

A preferred method of securing the nozzle member 21 in the position referred to above comprises the use of a settable cement in the following manner:

1. Before placing the nozzle member 21 in its final position shown in FIG. 3, a small quantity of a settable cement is applied to the internal thread 18 in the wear plate 16 and/or the external thread 22 on the nozzle member 21, preferably by applying the cement to the internal thread 18 only, before inserting the nozzle member 21 in the bore 17, in this manner preventing the cement from coming into contact with tools or the operator's fingers.

Figure 5:
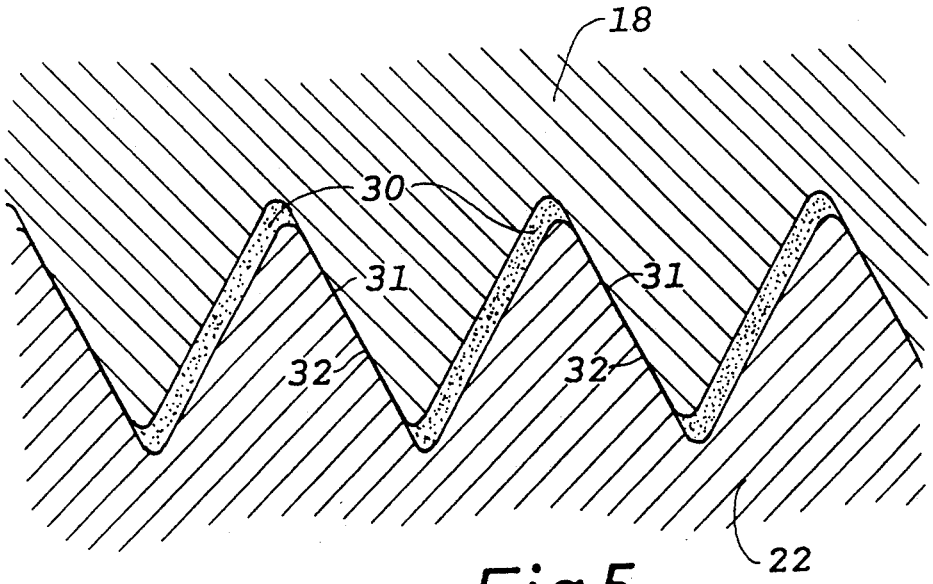
FIG. 5 is a greatly magnified sectional view showing the engagement between the screw-threads in the arrangement of FIG. 3, FIGS. 6, 7, 8 and 9 show four different examples of the use of mechanical locking means for securing the proper engagement of the nozzle member, while FIG. *7a* shows a portion of FIG. 7 drawn to an enlarged scale.

2. The nozzle member 21 is now screwed tight up against the abutment tool 23, the latter being held in engagement with the mold-chamber surface 20 for a period of time sufficient to allow the settable cement 30 shown in FIG. 5 to set and thus hold the flanks 31 on the nozzle-member thread 22 facing away from the mold-chamber surface 20 in abutment with the flanks 32 on the bore thread 18 facing toward the mold-chamber surface 20.

3. The abutment tool 23 is now removed, leaving the nozzle member 21 accurately centered in the bore 17 and with its mold-chamber face 26 in precise alignment with the mold-chamber surface 20 on the wear plate 16.

When the nozzle member 21 has been secured in the bore 17 in the manner described above, it cannot be dislodged by the pressure exerted upon it by the mold sand during the pressing operation described above with reference to FIGS. 1 and 2. Further, the nozzle member 21 will not interfere with the subsequent removal of the finished mold or mold part from the mold chamber by pushing the mold or mold part through the mold chamber in sliding relation with the wear plate 16, as the mold-chamber face 26 of the nozzle member 21 neither protrudes into the mold chamber nor recedes from it.

If the nozzle member 21 is to be removed from the wear plate 16, this can be done simply by unscrewing it using the tool referred to above. This will, of course, cause the bond provided by the cement 30 to be broken, but will not damage the threads 18 and 22, provided that the cement 30 is of a kind having a limited shear strength. For this purpose, a cement type "LOCTITE" ®-242 of normal strength (an anaerobic adhesive) has proved suitable, but other similar products may, of course, be used with the same effect.

In some instances, it may not be desirable or possible to use a settable cement for securing the nozzle member 21 in the bore 17 in ,the wear plate 16. In such cases, purely mechanically acting means may be used, e.g. as illustrated in FIGS. 6–9.

Figure 6:
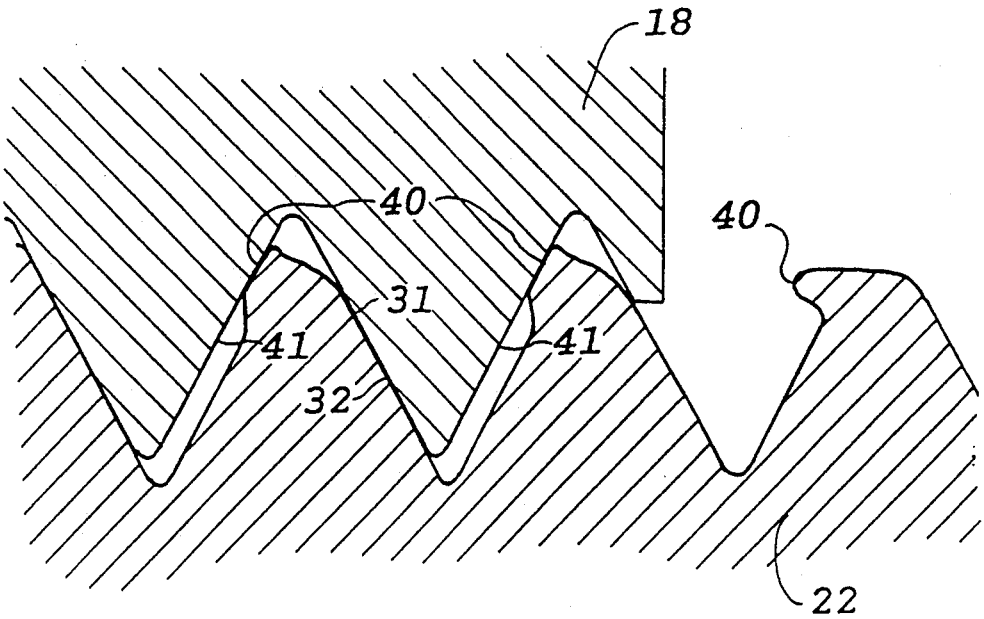

In the embodiment shown in FIG. 6, the external screw-thread 22 on the nozzle member has been deformed slightly by a tool (not shown) acting on the ridge or peak of the thread in the direction towards the abutment tool 23 (shown in FIG. 3) forming axially directed protrusions 40. Protrusions 40 have an axial width greater than the axial spacing between threads 18 and 22 shown in FIG. 5 as being occupied by the settable cement 30. When the nozzle member with its external thread 22 is screwed into the wear plate 16 with its internal thread 18, i.e. towards the left in FIG. 6 so as to come into abutment with the tool 23, the protrusions 40 will engage and be deformed by the oppositely situated flanks 41 on the thread 18 in the wear plate, the force of reaction pressing and keeping the flanks 31 in abutment with the flanks 32 in a manner similar to that of the settable cement 30 described with reference to FIG. 5.

Figure 7A:
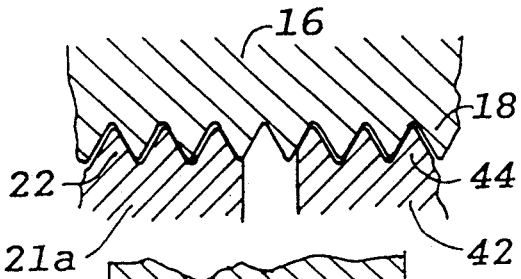
Figure 7:
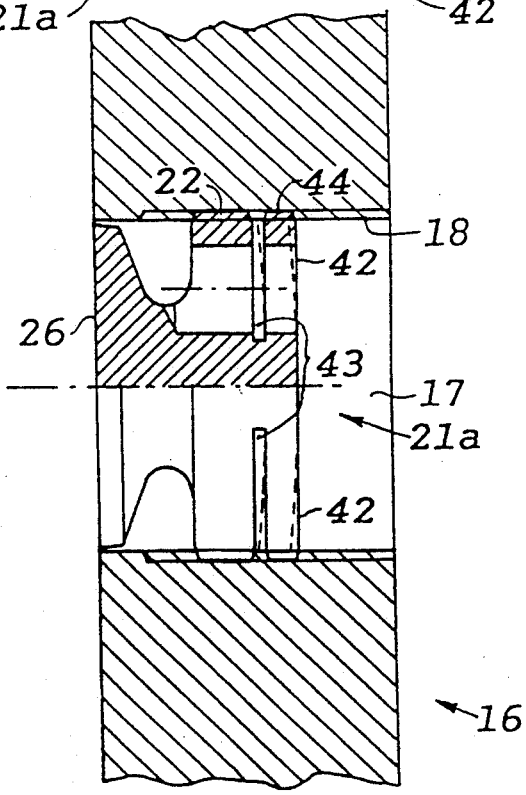

In the embodiment shown in FIG. 7, the nozzle member **21*a* has been provided with two springy wings 42 by cutting two slits 43 in the part of the nozzle member 21*a* facing away from the mold-chamber face 26. Prior to insertion, the wings 42 have been deformed beyond their elastic limit into the shape indicated in dotted lines, so that when the nozzle member 21*a* is screwed into the bore 17 in the wear plate 16 so as to come into abutment with the the abutment tool 23—if necessary after temporarily holding the wings 42 more or less at right angles to the bore as shown—the "forward" flanks on the external thread 44 on the wings 42 will press against the "rearward" flanks on the internal thread 18 in the bore 17 as indicated in the enlarged part-sectional view shown in FIG. 7***a*, thus holding the "rearward" thread flanks on the nozzle member 21*a* in abutment with the "forward" thread flanks in the bore 17 in the desired manner, "forward" and "rearward" meaning here, of course, towards and away from the mold-chamber surface respectively.

Figure 8:
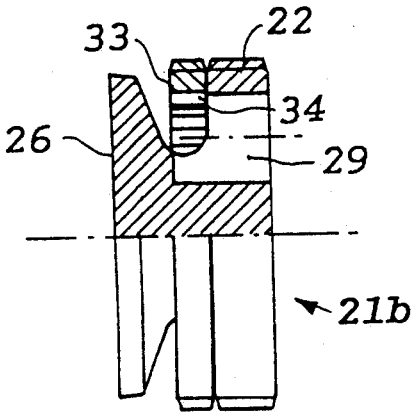

In the embodiment shown in FIG. 8, a nozzle member 21*b* is equipped with a threaded locking ring 33 with internal teeth 34. When a nozzle member 21*b* has been placed in position by screwing the mold-chamber face 26 tight up against the surface 24 on the abutment tool 23 in the manner described with reference to FIG. 3, it is secured in position by screwing the locking ring 33 tight against the part of the nozzle member 21*b* carrying the external thread 22, thus locking the latter in the position shown in FIG. 5. Turning of the toothed locking ring 33 may be effected by means of an externally toothed mandrel (not shown), that may be inserted through the hole 29; this mandrel may, of course, also be used when turning the whole nozzle member 21*b*. To make it possible to place the toothed looking ring 33 on the nozzle member 21*b*, it may be necessary to manufacture the latter in two parts, to be assembled when the locking ring 33 has been placed in position, or to reduce the diameter of the part carrying the mold-chamber face 26 to allow passage of the locking ring 33. In the latter case, the diameter of the unthreaded part of the bore 17 should, of course, be reduced correspondingly.

Figure 9:
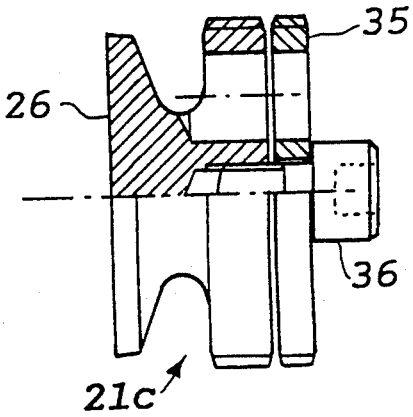

In the embodiment shown in FIG. 9, the securing is achieved by means of an externally threaded locking plate 35, which is placed at a small distance from the nozzle member 21*c* proper, a screw 36 in a controlled manner pulling the nozzle member toward the locking plate, so that the nozzle member 21*c* is maintained in its final position with the mold-chamber face 26 screwed tight up against the abutment tool 23.

Figure 10:
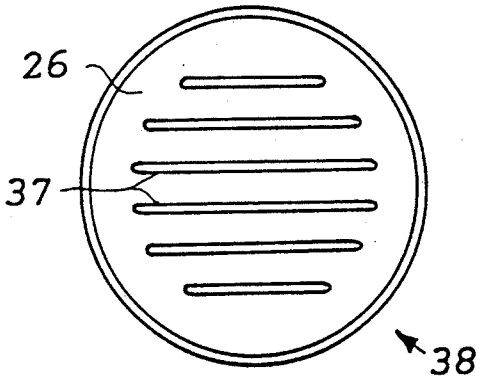
FIG. 10 shows a second exemplary embodiment of a nozzle member, seen from the mold-chamber side.
Figure 11:
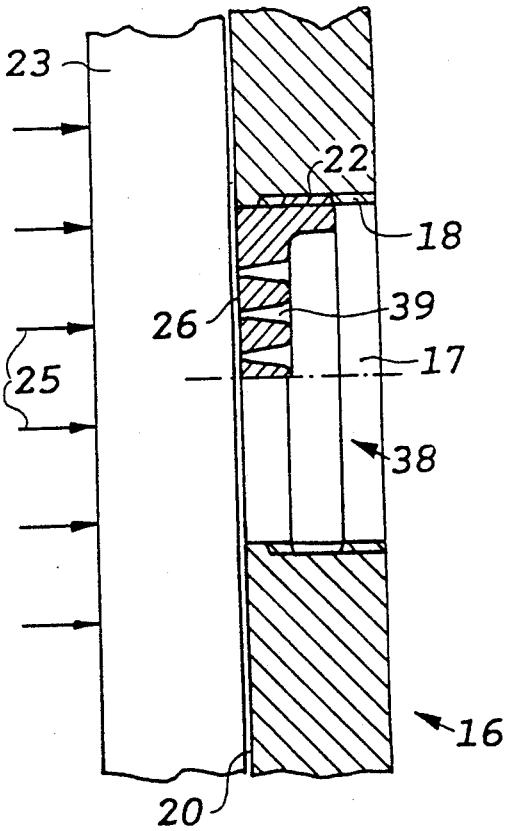
FIG. 11 shows the nozzle member of FIG. 10 in an arrangement similar to that of FIG. 3.

In the embodiment shown in FIGS. 10 and 11, the annular gap 27 shown in FIG. 3 is replaced by a number of linear slits 37 formed in the nozzle member 38 proper. The nozzle member 38 is inserted and secured in the operating position in the same manner as described above with reference to FIGS. 3–6, possibly using a turning tool (not shown) adapted to engage the widened parts 39 of the slits 37.

Figure 12:
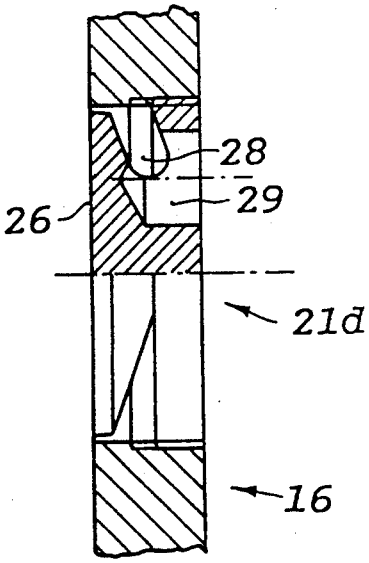
FIG. 12 shows an embodiment of a nozzle member used in a comparatively thin wear plate.

FIG. 12 shows an embodiment of the nozzle member 21*d* adapted for use in a comparatively thin wear plate 16. As there is no room for the arrangements shown in FIGS. 7–9, the nozzle member 21*d* is preferably secured in position with its mold-chamber face 26 screwed tight up against the abutment tool 23 in the same manner as described with reference to FIG. 5 or FIG. 6.

All the nozzle members 21, 21*a*, 21*b*, 21*c* and 21*d* and 38 may be manufactured from materials previously used for such nozzles, such as steel or a suitable powder-metallurgical material, preferably surface-treated and/or heat-treated for high wear resistance.

What is claimed is:

1. A wear plate for a mold chamber for use in the shaping of casting molds or mold parts from granular material, in which said wear plate including a mold-chamber surface facing the mold chamber and further including a plurality of air escape nozzle members distributed therein, said nozzle members being secured in through bores in said wear plate and adapted to allow the passage of air, but not said granular material, through said wear plate, the improvement wherein each nozzle member has external threads adapted to maintain the nozzle member accurately centered in the bore in corresponding internal threads in the bore and with an end surface of the nozzle member aligned with the mold-chamber surface of the wear plate, each nozzle member, during fitting thereof into said wear plate, having been screwed toward and subsequently tightened against a plane surface on an abutment tool placed in abutment with said mold-chamber surface of said wear plate and bridging the respective through bore, and the internal threads in the bores and the external threads of each nozzle including flanks and the flanks on said external threads facing away from said mold-chamber surface being in engagement with the flanks on said bore threads facing toward said surface, each nozzle member being secured in position upon engagement of said flanks.

2. A wear plate according to claim 1, wherein each nozzle member is screwed into the respective bore from the side of the wear plate facing away from said mold-chamber surface.

3. A wear plate according to claim 1 wherein each nozzle member is secured in the respective bore by means of a settable glue or cement distributed in the space between said external threads and said internal bore threads.

4. A wear plate according to claim 1, wherein each nozzle member is secured in the respective bore by an engaging member engaging the internal threads in the bore and permanently exerting a force on the nozzle member in a direction relative to said wear plate so as to maintain the nozzle member in said threaded engagement in the bore.

5. A wear plate according to claim 1, wherein said external threads include ridges, and each nozzle member is secured by means of protrusions on the ridges of the external threads thereof engaging the flanks on the internal threads in the respective bore which face away from the mold-chamber surface (20) on the wear plate.

6. A wear plate according to claim 4, said engaging member is constituted by a locking ring with external threads in engagement with the internal threads in the respective bore, said locking ring being screwed tight against a surface on the nozzle member facing toward said mold-chamber surface.

7. A wear plate according to claim 4, wherein said engaging member is constituted by a plate with an external thread in engagement with the internal threads in the bore and disposed on the end of the nozzle member facing away from said mold-chamber surface, said plate being spaced from the nozzle member and connected to the nozzle member by at least one screw each engaging a screw hole in the nozzle member.

8. A wear plate according to claim 4, wherein said engaging member is constituted by at least one springy wing with an external thread engaging the internal threads in the bore in such a manner that an elastic force produced by said at least one springy wing urges the nozzle member in a direction away from the mold-chamber surface.

9. A wear plate according to claim 8, wherein there are at least two springy wings placed symmetrically about the axis of the nozzle member.

10. A wear plate for a mold chamber for use in the shaping of casting molds or mold parts from granular material, in which said wear plate including a mold-chamber surface facing the mold chamber and further including a plurality of air escape nozzle members distributed therein, said nozzle members being secured in through bores in said wear plate and adapted to allow the passage of air, but not said granular material, through said wear plate, the improvement wherein each nozzle member has external threads adapted to maintain the nozzle member accurately centered in the bore in corresponding internal threads in the bore and with an end surface of the nozzle member aligned with the mold-chamber surface of the wear plate, each nozzle member, during fitting thereof into said wear plate, having been screwed toward and subsequently tightened against a plane surface on an abutment tool placed in abutment with said mold-chamber surface of said wear plate and bridging the respective through bore, and the internal threads in the bores and the external threads of each nozzle including flanks and the flanks on said threads facing away from said mold-chamber surface being in engagement with the flanks on said bore threads facing toward said surface, each nozzle member being secured in position upon the engagement of said flanks, and the diameter of the through bore into which each nozzle member is screwed, in a plane containing said end surface and the mold-chamber surface in alignment therewith, being no greater than the diameter of the bore throughout the remainder of the length of the bore.

11. A wear plate according to claim 10, wherein each nozzle member is screwed into the respective bore from the side of the wear plate facing away from said mold-chamber surface.

* * * * *